US008514077B2

(12) United States Patent
Rapp

(10) Patent No.: US 8,514,077 B2
(45) Date of Patent: Aug. 20, 2013

(54) SECURITY ASSEMBLY FOR USE WITH DISPOSABLE DISPLAYS

(75) Inventor: Michael Rapp, Modautal (DE)

(73) Assignee: Checkpoint Systems, Inc.

( * ) Notice: Subject to any disclaimer, the term of this patent is extended or adjusted under 35 U.S.C. 154(b) by 298 days.

(21) Appl. No.: 12/945,964

(22) Filed: Nov. 15, 2010

(65) Prior Publication Data

US 2012/0119909 A1 May 17, 2012

(51) Int. Cl.
*G08B 13/12* (2006.01)

(52) U.S. Cl.
USPC ..... 340/568.2; 340/568.8; 340/568.1; 340/571

(58) Field of Classification Search
USPC ..... 340/568.2, 568.8, 571, 539.1, 568.1, 340/572.1, 572.8, 572.9
See application file for complete search history.

(56) References Cited

U.S. PATENT DOCUMENTS 4,151,803 A 5/1979 Ferrera et al.
4,809,847 A 3/1989 Schneider
5,632,390 A 5/1997 Podergois
7,182,305 B2 2/2007 Dempsey
7,273,149 B2 * 9/2007 Lutes et al. ..... 206/768
7,672,872 B2 * 3/2010 Shanton ..... 705/22
7,701,339 B2 * 4/2010 Irmscher et al. ..... 340/568.1
7,724,135 B2 * 5/2010 Rapp et al. ..... 340/568.1
2003/0192809 A1 10/2003 Bucknell
2004/0011753 A1 * 1/2004 Field et al. ..... 211/132.1
2007/0229259 A1 10/2007 Irmscher et al.
2009/0033492 A1 2/2009 Rapp et al.
2010/0188222 A1 7/2010 Irmscher et al.

* cited by examiner

*Primary Examiner* — Toan N Pham

(57) ABSTRACT

A system and method for displaying merchandise item is presented. A disposable merchandise display includes a disposable display stand, an alarm unit and tethers. The disposable display stand is interchangeable with other disposable display stands and the alarm unit. The disposable display stand further includes one or more display areas for displaying merchandise items and allowing for the handling of the merchandise times. The alarm unit is configured to be placed inside the disposable display stand. Each of the tethers can be connected between the alarm unit and a corresponding merchandise item. The alarm unit is configured to generate an alarm when a merchandise item displayed at the merchandise display is moved away from the disposable merchandise display or a tether is cut.

23 Claims, 3 Drawing Sheets

SECURITY ASSEMBLY FOR USE WITH DISPOSABLE DISPLAYS

BACKGROUND OF THE INVENTION

1. Field of Invention

The current invention relates generally to apparatus, systems and methods for displaying items of merchandise. More particularly, the apparatus systems and methods relate to displaying items at a point-of-purchase display structure. Specifically, the apparatus, systems and methods provide for point-of-purchase display structure that is easily modified and that provides alarms for theft protection of items displayed at the display structure in a commercial environment.

2. Description of Related Art

Point-of-purchase display structures for displaying merchandise items are quickly and easily setup, knocked down and are easily changed. For example, these structures are useful for displaying changing promotional items that are changed often enough to keep consumer interest in the items displayed at the display structure. These display structures are often fabricated from plastic or paperboard materials. Because these structures are fabricated out of materials that can be easily broken, cut or torn, these display structures are best used to display inexpensive items where theft is of little concern. Thus, a better way of displaying valuable merchandise items may be desired.

SUMMARY OF THE INVENTION

The preferred embodiment of the invention includes a merchandise display for displaying merchandise items. The display includes a disposable display stand, an alarm unit and tethers. The disposable display stand can be fabricated out of cardboard and/or plastic boards. The disposable display stand is interchangeable with other disposable display stands and the alarm unit. The disposable display stand further includes display areas for displaying merchandise items and allowing for the handling of the merchandise items. The display areas include one or more shelves for displaying merchandise items. The alarm unit can be placed inside the disposable display stand. Each of the tethers can be connected between the alarm unit and a corresponding merchandise item. The alarm unit generates an alarm when a merchandise item displayed at the merchandise display is moved away from the merchandise display or a tether is cut.

In another configuration of the preferred embodiment, the merchandise display includes a power supply utilized to supply power to the alarm unit. The power supply can be configured to supply power through the plurality of tethers to one or more of the merchandise items on display.

Another configuration of the preferred embodiment includes a method for displaying merchandise items with disposable displays. The method assembles a lightweight disposable display formed with paper, plastic, corrugated paper, and/or corrugated plastic. Next, a power supply and/or alarm unit is installed inside the disposable display. An alarm unit can be installed in the disposable display. The alarm unit generates an alarm when a merchandise item is removed a predetermined distance from the disposable display. After the display is assembled, merchandise items are placed in the disposable display and the merchandise items are connected to the power supply.

Later, the method can create a new display by simply removing the merchandise items and the power supply and/or alarm unit from the disposable display. A different lightweight disposable display is assembled that is also formed with paper, plastic, corrugated paper and/or corrugated plastic. The power supply and/or alarm unit is then reinstalled inside the new disposable display. The merchandise items are then replaced on the new disposable display and the merchandise items are reconnected to the power supply and/or alarm unit.

BRIEF DESCRIPTION OF SEVERAL VIEWS OF THE DRAWINGS

One or more preferred embodiments that illustrate the best mode(s) are set forth in the drawings and in the following description. The appended claims particularly and distinctly point out and set forth the invention. The accompanying drawings, which are incorporated in and constitute a part of the specification, illustrate various example methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DESCRIPTION OF THE PREFERRED EMBODIMENTS

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed aspects.

Unless defined otherwise, all technical and scientific terms used herein have the same meaning as commonly understood to one of ordinary skill in the art to which this invention belongs. Although any methods, devices, or materials similar or equivalent to those described herein can be used in the practice or testing of the invention, the preferred methods, devices, and materials are now described.

Figure 1:
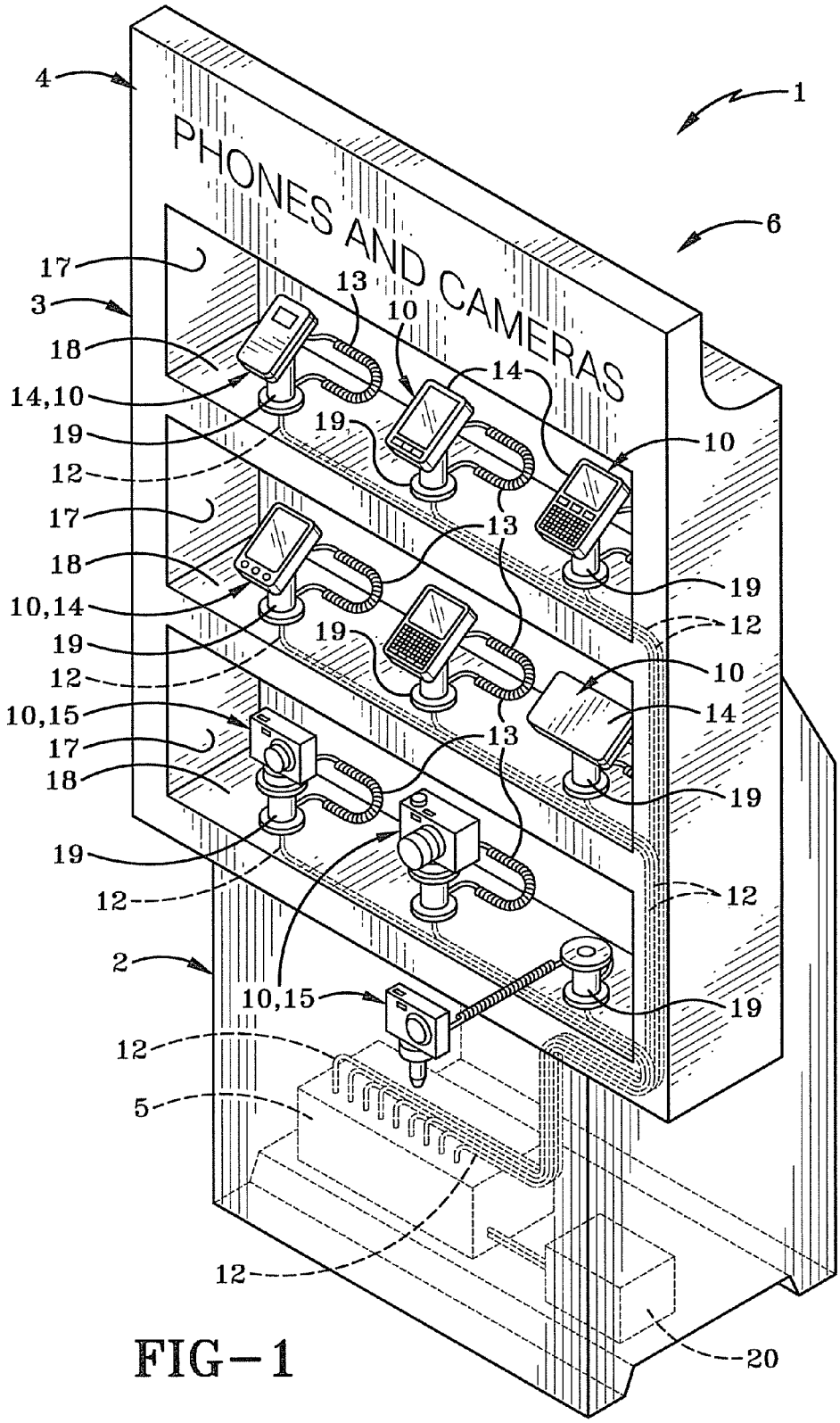
FIG. 1 illustrates a preferred embodiment of disposable display with security with an alarm unit in a base unit of the display.

FIG. 1 illustrates the preferred embodiment of a merchandise display 1 for securely displaying merchandise items. The merchandise display 1 can include a base unit 2, several shelving units 3, a signage riser 4 and an alarm unit 5. The base unit 2, several shelving units 3 and signage riser 4 can form a disposable display stand. The merchandise display 1 is disposable because it is formed out of inexpensive cardboard and/or plastic boards or other material rather wood or other traditional materials. The shelving units 3 can form interior chambers 17 where merchandise items 10 can be displayed on shelf surfaces 18. The merchandise items 10 are displayed on the shelving units 3 so these items can be handled by a customer while the customer decides whether to purchase one of the merchandise items 10. The merchandise items 10 can be electronic items such as cellular phones 14, cameras 15, personal digital assistants, and the like.

The merchandise display 1 is an improvement over prior art displays because the structure of the display is disposable while the security features of the display 1 can be reused with other disposable structures. For example, the merchandise display 1 can be configured with an advertising theme and signage 4 for one marketing theme. This marketing scheme can be quickly changed by removing the merchandise items 10 and alarm unit 5 from the disposable base unit 2 and shelve units 3. The signage 4, other portion or the entire merchandise display 1 is removed. A new base unit 2, shelve units 3 and/or signage 4 can then be reassembled to create a disposable merchandise display 1 with a new marketing theme. The merchandise items 10 are then reconnected to the alarm unit 5 inside the new merchandise display 1. This allows for the rapid changing of advertising material printed on the disposable display 6 or the color theme of the display 6.

As previously mentioned, the disposable display stand 6 can be made out of paper, plastic, corrugated paper, corrugated plastic, and/or other lightweight materials that are inexpensive and can be easily disposed of. Those of ordinary skill in the art will realize that other materials may be used to construct the base unit 2, shelf units 3 and signage 4 of the disposable merchandise display 1. The disposable merchandise display 1 may be formed from flat sheets of corrugated material that has been cut and creased to allow folds to easily later be made when folding material while assembling the display 6.

The alarm unit 5 can be sized to allow the base unit 2 to be positioned over the alarm unit 5 and sat atop of the alarm unit 5. Alternatively, the alarm unit 5 may be small enough to fit within a chamber in the base unit 2. The merchandise items 10 can be connected to the alarm unit 5 with electrical tethers 12. The alarm unit 5 will generate an alarm when it detects a tether 12 has been cut or a merchandise item 10 has been removed from a tether 12. The alarm may be an audible alarm, an alarm message transmitted to store personnel or another type of alarm.

In another configuration of the preferred embodiment, the merchandise items 10 are not connected to the alarm unit 5 with tethers 12. Instead, the alarm unit 5 is configured to wirelessly track the movement of the merchandise items 10 relative to the alarm unit 5. When a merchandise item 10 is determine to have been moved more than a predetermined distance from the alarm unit 5, the alarm unit 5 is configured to generate the alarm.

In one configuration of the preferred embodiment, the shelf units 3 may be modular and may be stacked atop each other. The shelf units 3 are generally box shaped with openings in the front to allow viewing of the merchandise items 10. The merchandise items 10 are placed on a lower shelf portion 18 that is a generally planar flat surface. In some embodiments of the preferred embodiment, pedestals 19 can be attached to the lower shelf portions 18 so that the merchandise items 10 and be angled for better viewing. The tethers 12 can pass through the center of the pedestals 19. A re-coiler can be attached to the bottom of the pedestals 19 to automatically recoil the tether 12 back in to the re-coiler when a merchandise item 10 is returned to the pedestal 19.

A power supply 20 can also be placed into the base unit 2. The power supply 20 can supply power to the alarm unit 5 and to conductors in the tethers 12 connected to the alarm unit 5. The power supply 20 can supply power to the merchandise items 10 on a round robin basis. The power supply 20 may detect which tethers (or alarm unit ports) are connected to a merchandise item 10 and then only supply power to the tethers or port connected to a merchandise item 10.

Figure 2:
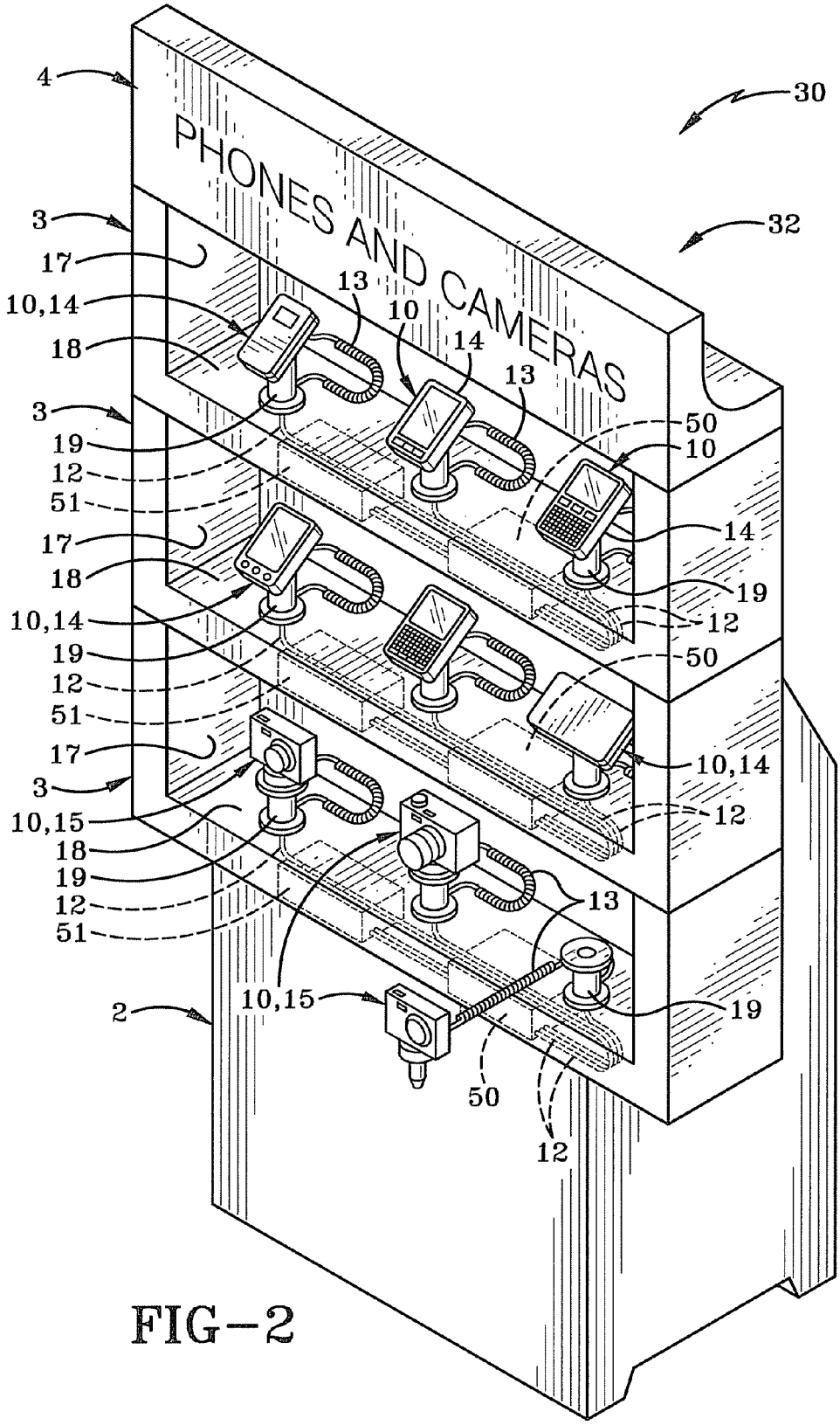
FIG. 2 illustrates the preferred embodiment of disposable display with security with alarm units in shelve units of the display.

FIG. 2 illustrates a configuration of the preferred embodiment with an alarm unit 50 located in a lower chamber beneath the lower shelf portion 18 of each shelf unit 3. These alarm units 50 monitor merchandise items 10 located on the shelf unit 3 associated with the corresponding alarm unit 50 beneath that shelf unit 3. The alarm units 50 for each shelf unit 3 will operate similar as the alarm unit 5 of FIG. 1; however, the alarm units 50 of FIG. 2 will monitor merchandise items 10 on a shelf unit 3 basis. Similar to the alarm units 50, power supply units 51 can be located beneath corresponding shelf units 3 and power the alarm units 5 on a shelf unit 3 basis.

Example methods may be better appreciated with reference to flow diagrams. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks.

Figure 3:
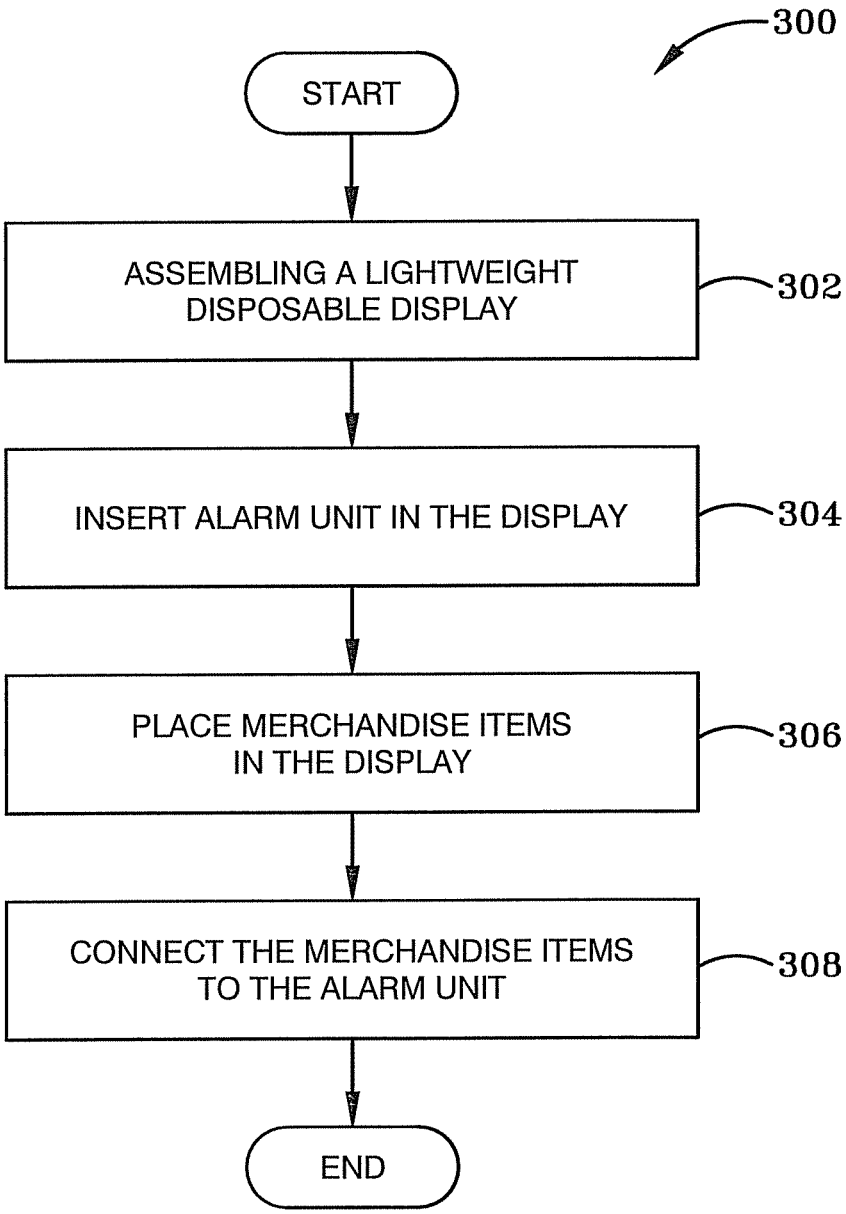
FIG. 3 illustrates an embodiment of a method for protecting merchandise items with a disposable display.

FIG. 3 illustrates a method 300 of protecting merchandise items at a disposable merchandise display. The method 300 begins by assembling a lightweight disposable display at 302. The disposable merchandise display is formed with paper, cardboard, plastic, corrugated paper, corrugated plastic and/or other materials. An alarm unit is placed inside the disposable display at 304 that is configured to determine when a merchandise item displayed at the display is moved too far from the display. Merchandise items are place in the disposable display at 306. The merchandise items are connected to the alarm unit at 308.

Later, the disposable merchandise display can be quickly replaced with a new disposable merchandise display. First, the merchandise items and the power supply are removed from the original disposable display. Next, an updated disposable display is assembled that is formed with paper, plastic, corrugated paper, corrugated plastic other materials. The alarm unit is then reinstalled inside the updated disposable display. The merchandise items are replaced into the updated disposable display. Finally, the merchandise items are reconnected to alarm unit.

In the foregoing description, certain terms have been used for brevity, clearness, and understanding. No unnecessary limitations are to be implied therefrom beyond the requirement of the prior art because such terms are used for descriptive purposes and are intended to be broadly construed. Therefore, the invention is not limited to the specific details, the representative embodiments, and illustrative examples shown and described. Thus, this application is intended to embrace alterations, modifications, and variations that fall within the scope of the appended claims.

Moreover, the description and illustration of the invention is an example and the invention is not limited to the exact details shown or described. References to "the preferred embodiment," "an embodiment," "one example," "an example," and so on indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in the preferred embodiment" does not necessarily refer to the same embodiment, though it may.

What is claimed is:

1. A merchandise display system for securely displaying merchandise items comprising:

a first disposable display stand;

an alarm unit configured to be placed inside the first disposable display stand; wherein the first disposable display stand comprises:

one or more display areas for displaying merchandise items and allowing for the handling of the merchandise items; and a plurality of tethers, wherein each of the plurality of tethers is configured to be connected between the alarm unit and a corresponding merchandise item, wherein the alarm unit is configured to generate an alarm when a merchandise item displayed at the first disposable display stand is moved away from the first disposable display stand or a tether is cut; and further comprising:

a second disposable display stand having one or more display areas for displaying and allowing for the handling of merchandise items;

wherein the alarm unit is movable from inside the first display stand and configured to be placed inside the second disposable display stand and connected to merchandise items displayed at the second disposable display stand.

2. The merchandise display of claim 1 wherein the one or more display areas of at least one of the first and second display stands include one or more shelves for displaying merchandise items.

3. The merchandise display of claim 1 further comprising a power supply to supply power to the alarm unit.

4. The merchandise display of claim 3 wherein the power supply is configured to supply power through the plurality of tethers to one or more of the merchandise items on display.

5. The merchandise display of claim 1 wherein at least one of the disposable display stands is fabricated out of cardboard and/or plastic boards.

6. The merchandise display of claim 1 wherein at least one of the display stands further comprises:

a plurality of pedestals for displaying a corresponding merchandise item on a corresponding pedestal.

7. The merchandise display of claim 1 wherein at least one of the disposable display stands further comprises:

one or more predefined fold lines configured to allow the at least one of the disposable display stands to be folded at one or more locations before the at least one of the disposable display stands is placed over the alarm unit.

8. The merchandise display of claim 1 further comprising:

two or more disposable shelves for displaying merchandise items;

two or more power supply units, wherein at least some of the disposable shelves correspond to one of the power supply units, wherein the disposable shelves are configured to enclose a corresponding power supply unit, wherein the plurality of tethers includes two or more tethers to connect merchandise items to the power supply units, and wherein the power supply units are configured to supply power to the merchandise items connected to the power supply units by the tethers.

9. The merchandise display of claim 8 wherein a first power supply unit corresponding to a first disposable shelf is configured to supply power to merchandise items displayed on the first disposable shelf, and wherein a second power supply unit corresponding to a second disposable shelf is configured to supply power to merchandise items displayed on the second disposable shelf.

10. The display of claim 8 wherein the disposable shelves are formed with at least one of the group of corrugated paper and/or corrugated plastic.

11. The merchandise display of claim 8 wherein the disposable shelves further comprise:

a shelf base;

a flat planar surface for displaying the merchandise items on top of the flat planar surface, wherein the flat planar surface is above the shelf base and a corresponding power supply is located within the shelf base.

12. A method for displaying merchandise items with disposable displays comprising:

assembling a first disposable display;

installing at least one alarm unit inside the first disposable display, wherein the at least one alarm unit is configured to generate an alarm when a merchandise item is removed a predetermined distance from the first disposable display;

placing merchandise items in the first disposable display;

connecting the merchandise items to the at least one alarm unit;

removing the merchandise items and the at least one alarm unit from the first disposable display;

assembling a second disposable display;

installing the at least one alarm unit inside the second disposable display;

placing merchandise items in the second disposable display; and connecting the merchandise items in the second disposable display to the at least one alarm unit.

13. The method of claim 12 wherein at least one of the first disposable display and the second disposable display is formed with at least one of the group of paper, plastic, corrugated paper, and/or corrugated plastic.

14. The method of claim 13 wherein each of the first disposable display and the second disposable display is formed with at least one of the group of paper, plastic, corrugated paper, and/or corrugated plastic.

15. The method of claim 12 wherein the assembling a first disposable display further comprises:

assembling a base unit;

assembling a merchandise display unit;

attaching the merchandise display unit to a top of the base unit, wherein the installing at least one alarm unit further comprises:

installing the at least one alarm unit inside the base unit, wherein the placing merchandise items further comprises:

placing merchandise items on the merchandise display unit.

16. The method of claim 12 wherein the assembling a first disposable display further comprises:

assembling a base unit;

assembling a first shelf unit and a second shelf unit;

attaching the first shelf unit to the base unit and the second shelf unit to the first shelf unit, wherein the installing at least one alarm unit further comprises:

installing a first alarm unit inside the first shelf unit and installing a second alarm unit inside the second shelf unit.

17. The method of claim 12 wherein the assembling a first disposable display further comprises:

installing at least one signage riser to the first disposable display for displaying information about the merchandise items.

18. The method of claim 12 further comprising:

installing a power supply into the first disposable display, wherein the power supply is configured to supply power to the at least one alarm unit and the merchandise items displayed at the first disposable display.

19. The method of claim 12 wherein the assembling a first disposable display further comprises:

folding portions of the first disposable display along prefolded seams.

20. A system comprising:

a first merchandise display;

a second merchandise display;

a portable alarm unit configured to be placed inside the first merchandise display and connected to merchandise items displayed at the first merchandise display, and configured to be removed from the first merchandise display and placed inside the second merchandise display and connected to merchandise items displayed at the second merchandise display;

a plurality of sensors configured to detect when a merchandise item is removed from the merchandise display the portable alarm unit is inside; and alarm logic configured to generate an alarm signal when it is detected that a merchandise item is removed from the merchandise display the portable alarm unit is inside.

21. The reusable alarm system of claim 20 further comprising:

a plurality of tethers configured to be connected between merchandise items on display at the merchandise display the portable alarm unit is inside and the portable alarm unit.

22. The reusable alarm system of claim 20 wherein the plurality of sensors are configured to detect when a merchandise item is removed from the merchandise display the portable alarm unit is inside by determining when a merchandise item is moved a predetermined distance from the merchandise display the portable alarm unit is inside.

23. The reusable alarm system of claim 20 wherein the portable alarm system further comprises:

a power source configured to supply power to merchandise items at the merchandise display the portable alarm unit is inside.

* * * * *